US011891714B2

(12) United States Patent
Matsuyama et al.

(10) Patent No.: US 11,891,714 B2
(45) Date of Patent: Feb. 6, 2024

(54) HOLDING APPARATUS

(71) Applicant: C. Uyemura & Co., Ltd., Osaka (JP)

(72) Inventors: Daisuke Matsuyama, Hirakata (JP); Daisuke Hashimoto, Hirakata (JP); Kazuyoshi Nishimoto, Hirakata (JP); Tomoji Okuda, Hirakata (JP)

(73) Assignee: C. UYEMURA & CO., LTD., Osaka (JP)

( * ) Notice: Subject to any disclaimer, the term of this patent is extended or adjusted under 35 U.S.C. 154(b) by 193 days.

(21) Appl. No.: 17/060,375

(22) Filed: Oct. 1, 2020

(65) Prior Publication Data

US 2021/0102306 A1 Apr. 8, 2021

(30) Foreign Application Priority Data

Oct. 7, 2019 (JP) ..... 2019-184835

(51) Int. Cl.
*C25D 17/06* (2006.01)
*C25D 17/10* (2006.01)

(52) U.S. Cl.
CPC ..... *C25D 17/06* (2013.01); *C25D 17/10* (2013.01)

(58) Field of Classification Search
None
See application file for complete search history.

(56) References Cited

U.S. PATENT DOCUMENTS

2002/0000372 A1* 1/2002 Pedersen ..... C25D 17/001 204/279
2005/0014368 A1* 1/2005 Yoshioka ..... C25D 17/08 438/689
2006/0191786 A1 8/2006 Yamamoto et al.
2017/0372937 A1* 12/2017 Keigler ..... C25D 17/001
2020/0149180 A1 5/2020 Nishimoto et al.

FOREIGN PATENT DOCUMENTS

CN 206814873 12/2017
CN 208455094 2/2019
CN 109778289 5/2019
(Continued)

OTHER PUBLICATIONS

Search Report and Written Opinion dated Nov. 3, 2021 in Singapore Patent Application No. 10202009909S.
(Continued)

*Primary Examiner* — Louis J Rufo
(74) *Attorney, Agent, or Firm* — Wenderoth, Lind & Ponack, L.L.P.

(57) ABSTRACT

A holding apparatus for applying an electrolytic plating treatment to a planar workpiece, and the holding apparatus can reduce an amount of plating that is deposited on an edge part of the planar workpiece. The holding apparatus for applying the electrolytic plating treatment to the planar workpiece has a rear member and a front member facing the rear member and having an opening part. The planar workpiece is disposed between the rear member and the front member. The front member has a plurality of electrodes and a plurality of first insulating parts. The plurality of electrodes and the plurality of first insulating parts cover the edge part of the planar workpiece in a width direction of the planar workpiece.

12 Claims, 6 Drawing Sheets

(56) References Cited

FOREIGN PATENT DOCUMENTS

| | | |
|---|---|---|
| JP | 2002-161398 | 6/2002 |
| JP | 2015-101764 | 6/2015 |
| WO | 2019/021607 | 1/2019 |

OTHER PUBLICATIONS

Office Action dated Apr. 25, 2023 in corresponding Japanese Patent Application No. 2019-184835, with machine English translation.
Office Action dated Sep. 29, 2023 in counterpart Chinese Application No. 202011048095.6, with English machine translation.

* cited by examiner

[FIG.1]
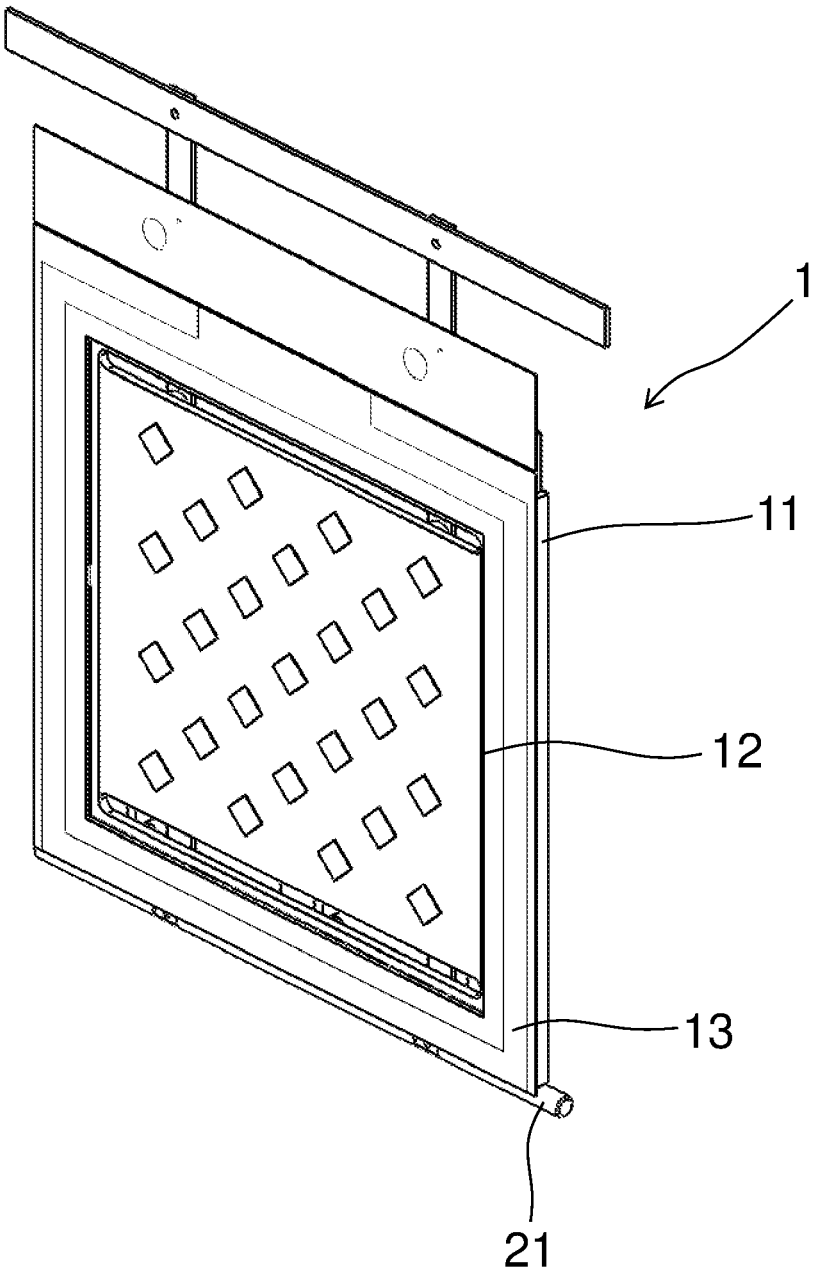

[FIG.2]
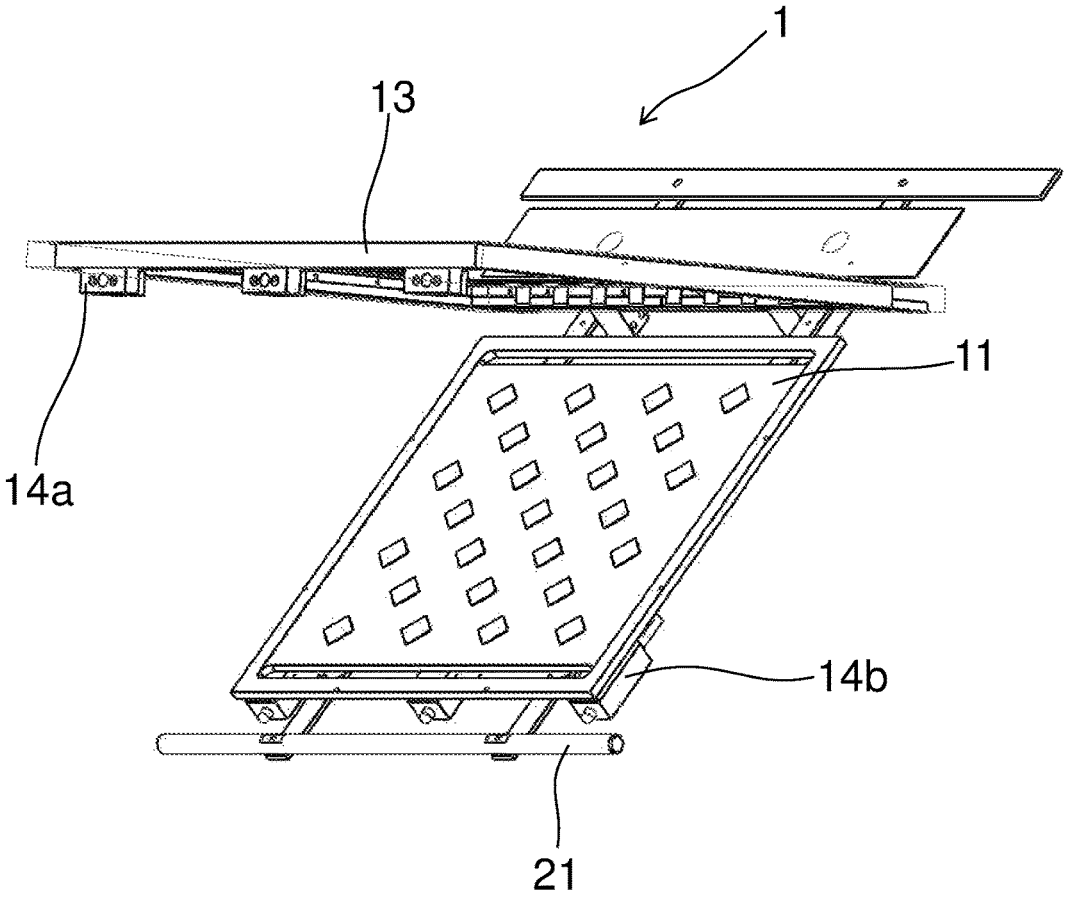

[FIG.3]
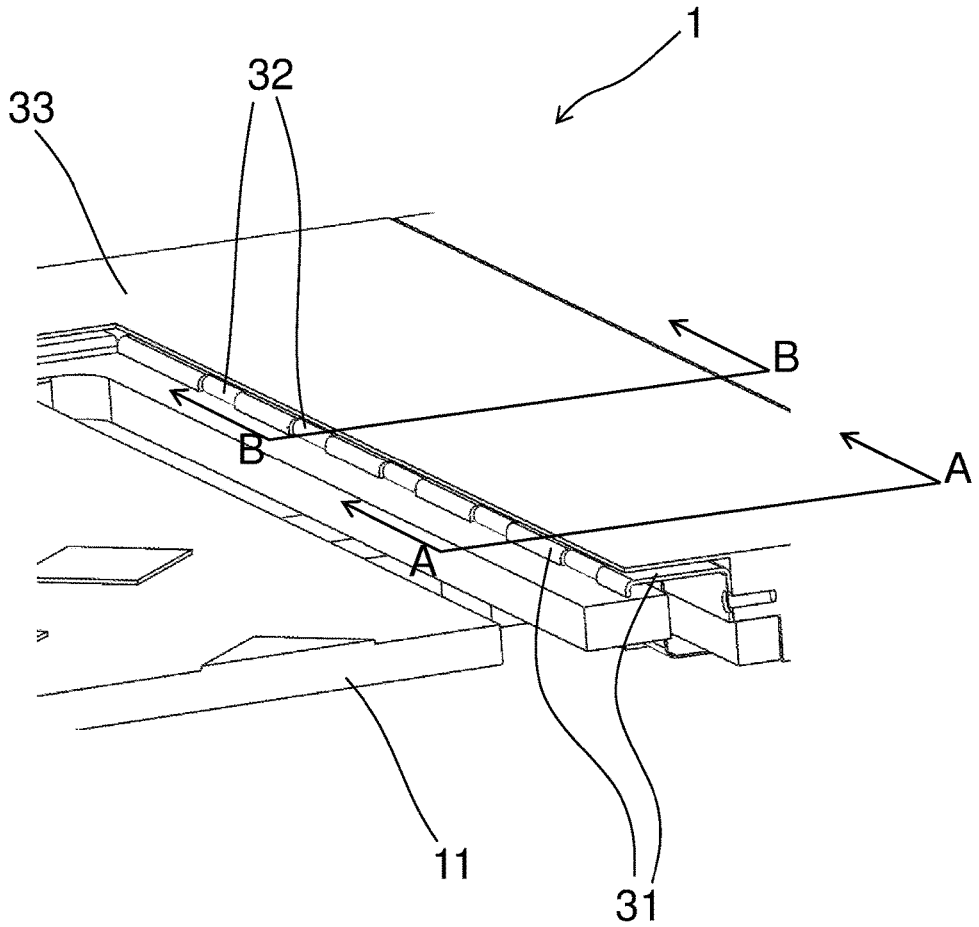

[FIG. 4]
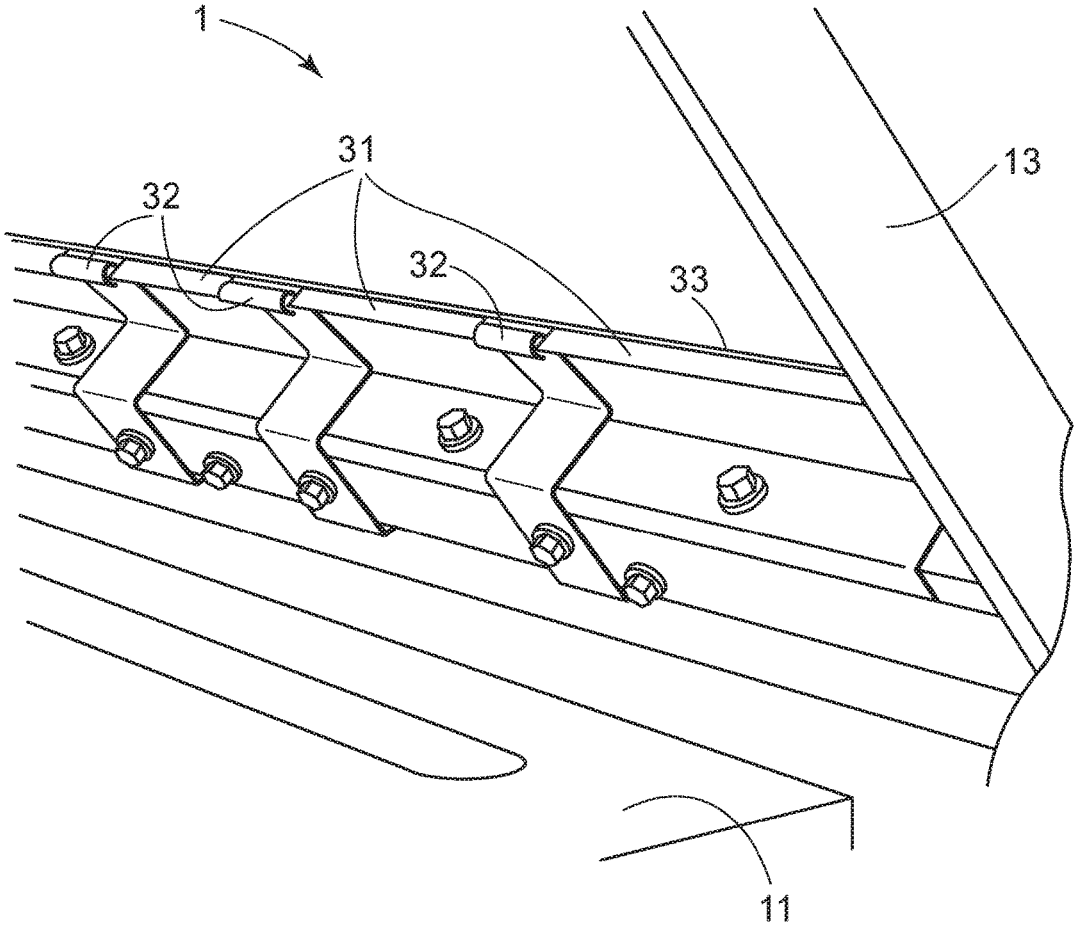

HOLDING APPARATUS

CROSS-REFERENCE TO RELATED APPLICATIONS

This application is related to and claims priority under 35 U.S.C. 119 to Japanese patent application No. 2019-184835, filed on Oct. 7, 2019.

BACKGROUND OF THE INVENTION

1. Technical Field

An embodiment of the present invention relates to a holding apparatus for applying an electrolytic plating treatment to a planar workpiece disposed between a rear member and a front member facing the rear member and having an opening part.

2. Description of the Related Art

Upon applying an electrolytic plating treatment to a planar workpiece, a holding apparatus for fixing the planar workpiece is used, for example. The planar workpiece that is fixed to the holding apparatus is immersed in a liquid bath in a manner that the planar workpiece and an anode electrode are disposed to face one another. An electric current is then provided between the planar workpiece and the anode electrode to perform the electrolytic plating treatment. The holding apparatus for fixing the planar workpiece has, for example, a rear member and a front member facing the rear member and having an opening part. The planar workpiece is disposed between the rear member and the front member.

A plating film formed by an electrolytic plating treatment is required to have a uniform thickness. However, a thickness of a plating film is susceptible to electric field distribution between a planar workpiece and an anode electrode. In particular, a thickness of a plating film around a cathode electrode, which is in contact with the planar workpiece, tends to be larger than the other parts of the planar workpiece. A known method for achieving a uniform thickness of a plating film is to dispose a shielding plate between a planar workpiece and an anode electrode for a purpose of controlling a flow of an electric current to generate uniform electric field distribution.

JP-A-2002-161398 discloses a substrate holder with a shielding plate. This substrate holder has a front pressing plate and a rear pressing plate that can be swung with ease. In addition to providing the substrate holder with the shielding plate, the front and rear pressing plates are formed from a non-conductive resin, and in these pressing plates, a conducting bar is embedded. The substrate holder also has electric current-transmitting pins that are connected to the conducting bar and provided in the front and rear pressing plates in a manner that one electric current-transmitting pin contacts another electric current-transmitting pin on inner contact surfaces of the front and rear pressing plates. In addition, the substrate holder has a mechanism for clamping the front and rear pressing plates together.

SUMMARY OF THE INVENTION

1. Technical Problem

The substrate holder with the shielding plate in JP-A-2002-161398 enables a thickness of a plating film to become uniform but allows an edge part of a planar workpiece to be plated in some cases.

The present invention has been accomplished considering the above circumstances, and an object of the present invention is to provide a holding apparatus for applying an electrolytic plating treatment to a planar workpiece. The holding apparatus can reduce an amount of plating that is deposited on an edge part of the planar workpiece. Another object of the present invention is to provide a method for applying an electrolytic plating treatment to a planar workpiece with the holding apparatus.

2. Solutions to the Problems

An embodiment of the present invention includes the followings.

[1] A holding apparatus for applying an electrolytic plating treatment to a planar workpiece comprising:

a rear member; and a front member facing the rear member and having an opening part, wherein the planar workpiece is disposed between the rear member and the front member, the front member has a plurality of electrodes and a plurality of first insulating parts, the plurality of electrodes and the plurality of first insulating parts cover an edge part of the planar workpiece in a width direction of the planar workpiece, provided that an edge length of the planar workpiece in the width direction of the planar workpiece or an edge length of the opening part in a direction parallel to the width direction of the planar workpiece, whichever is smaller, is defined as 100, an edge part-covering length of the plurality of first insulating parts or the plurality of electrodes is 80 or more in the width direction of the planar workpiece within the edge length of the planar workpiece in the width direction of the planar workpiece.

[2] The holding apparatus according to above [1], wherein each of the first insulating parts has a projection towards the rear member.

[3] The holding apparatus according to above [2], wherein the projection is formed across each of the first insulating parts in a width direction of each of the first insulating parts.

[4] The holding apparatus according to any one of above [1] to [3], wherein an end of each of the electrodes contacts the planar workpiece, the end has a curved part towards the planar workpiece, and the curved part is formed across each of the electrodes in a width direction of each of the electrodes.

[5] The holding apparatus according to any one of above [1] to [4], wherein the front member has a second insulating part, and the second insulating part covers each of the first insulating parts and/or each of the electrodes.

[6] The holding apparatus according to above [5], wherein the second insulating part has a projection towards the rear member, the projection is formed at a peripheral edge of the opening part.

[7] The holding apparatus according to any one of above [1] to [6], wherein each of the first insulating parts contacts the edge part of the planar workpiece.

[8] The holding apparatus according to any one of above [1] to [7], wherein each of the first insulating parts and each of the electrodes are disposed alternately along an edge of the planar workpiece.

[9] The holding apparatus according to any one of above [1] to [8], wherein each of the first insulating parts and each of the electrodes are disposed alternately along the edge of the planar workpiece and are in contact with one another.

[10] The holding apparatus according to any one of above [1] to [9], wherein each of the electrodes is covered with an insulating film except for a contact point of each of the electrodes with the planar workpiece.

[11] A method for applying an electrolytic plating treatment to a planar workpiece with the holding apparatus according to any one of above [1] to [10], wherein the electrolytic plating treatment is performed with each of the electrodes in contact with a plating solution.

3. Advantageous Effects of the Invention

In the holding apparatus according to the present invention, the plurality of electrodes and the plurality of first insulating parts cover a predetermined range of the edge part of the planar workpiece in the width direction of the planar workpiece when the planar workpiece is disposed between the rear member and the front member. This cover enables proper control of a flow of an electric current and then uniform electric field distribution, thus rendering the electric current less likely to flow into the edge part of the planar workpiece. As a result, even though an electrolytic plating treatment is applied to the planar workpiece, an amount of plating that is deposited on the edge part of the planar workpiece can be reduced.

BRIEF DESCRIPTION OF THE DRAWINGS

FIG. 1 is a perspective view showing a holding apparatus according to an embodiment of the present invention with a rear member and a front member being closed.

FIG. 2 is a perspective view showing a holding apparatus according to an embodiment of the present invention with a rear member and a front member being opened.

FIG. 3 is a perspective view (partly a cross-sectional view) showing a connecting part of a rear member and a front member in a holding apparatus according to an embodiment of the present invention with the rear member and the front member being closed.

FIG. 4 is a perspective view showing a connecting part of a rear member and a front member in a holding apparatus according to an embodiment of the present invention with the rear member and the front member being opened.

FIG. 6(A) shows a case where a width of an opening part is smaller than a length of the planar workpiece, and FIG. 6(B) shows a case where a length of the planar workpiece is smaller than a width of an opening part.

DETAILED DESCRIPTION OF EMBODIMENTS OF THE INVENTION

Figure 5A:
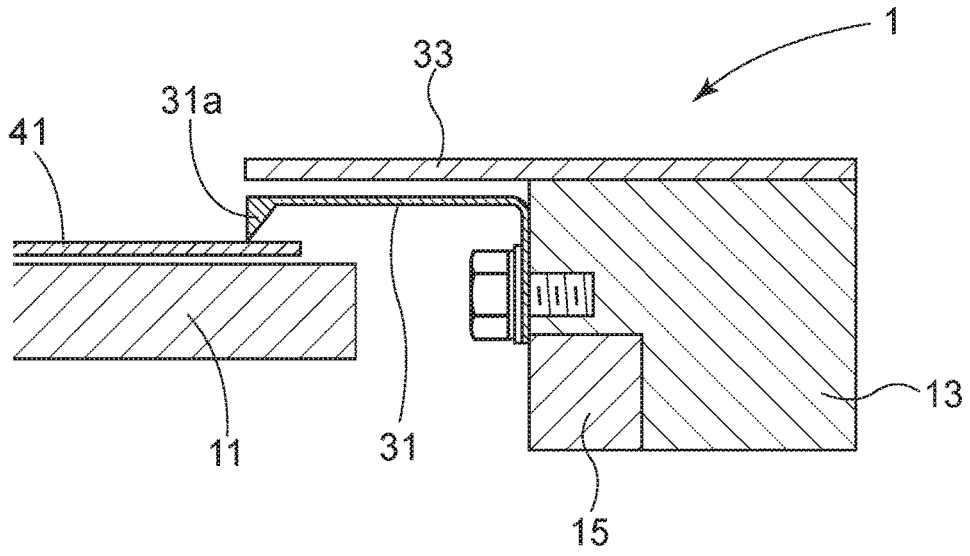
FIG. 5(A) is a cross-sectional view showing the holding apparatus in FIG. 3 that is taken along the line A-A.

A holding apparatus according to the present invention is for applying an electrolytic plating treatment to a planar workpiece. The holding apparatus has a rear member and a front member facing the rear member and having an opening part. The planar workpiece is disposed between the rear member and the front member. The front member has a plurality of electrodes and a plurality of first insulating parts. The plurality of electrodes and the plurality of first insulating parts cover an edge part of the planar workpiece in a width direction of the planar workpiece. Provided that an edge length of the planar workpiece in the width direction of the planar workpiece or an edge length of the opening part in a direction parallel to the width direction of the planar workpiece, whichever is smaller, is defined as 100, an edge part-covering length of the plurality of electrodes or the plurality of first insulating parts is 80 or more in the width direction of the planar workpiece within the edge length of the planar workpiece in the width direction of the planar workpiece.

Hereinbelow is concretely described the holding apparatus according to an embodiment of the present invention with reference to the drawings. An embodiment of the present invention is, however, not limited to the illustrated examples and can be put into practice after appropriate modifications within a range meeting the gist of the above and the below. All of these are included in the technical scope of an embodiment of the present invention.

FIGS. 1 and 2 are perspective views showing the holding apparatus 1 according to an embodiment of the present invention. In FIG. 1, the rear member 11 and the front member 13, which faces the rear member 11 and has the opening part 12, are closed. In FIG. 2, the rear member 11 and the front member 13 are opened. Disposing a planar workpiece between the rear member 11 and the front member 13 enables the holding apparatus 1 to hold the planar workpiece. In FIGS. 1 and 2, the planar workpiece is not illustrated.

The front member 13 of the holding apparatus 1 has the plurality of electrodes and the plurality of first insulating parts. The plurality of electrodes and the plurality of first insulating parts cover the edge part of the planar workpiece in the width direction of the planar workpiece. Each of the electrodes is connected to a wire and a power source, and can transmit an electric current to the planar workpiece when coming into contact with the planar workpiece. Each of the first insulating parts shields the edge part of the planar workpiece in such a manner as to prevent the electric current from flowing into the edge part. Forming the first insulating parts on the front member can lead to reduction in an amount of plating that is deposited on the edge part of the planar workpiece.

The number of the electrodes merely needs to be plural, namely 2 or more, and is not particularly limited thereto. The number may be determined based upon sizes of the holding apparatus 1 and the planar workpiece, electric field distribution, or the like. A larger number of the electrodes can prevent a concentration of electric currents to a greater degree, thus being able to achieve a uniform thickness of a plating film. The number of the electrodes is preferably 4 or more, and more preferably 6 or more, for example. The upper limit of the number of the electrodes is 10 or less, for example.

The number of the first insulating parts merely needs to be plural, namely 2 or more, and is not particularly limited thereto. The number may be determined based upon sizes of the holding apparatus 1 and the planar workpiece, electric field distribution, or the like. A larger number of the first insulating parts can prevent a concentration of electric currents to a greater degree, thus being able to achieve a uniform thickness of a plating film. The number of the first insulating parts is preferably 4 or more, and more preferably 6 or more, for example. The upper limit of the number of the first insulating parts is 10 or less, for example.

The number of the electrodes and the number of the first insulating parts may be the same but are preferably different. The number of the first insulating parts is more preferably larger than the number of the electrodes. A larger number of the first insulating parts than the number of the electrodes can prevent an electric current from flowing into the edge part of the planar workpiece, thus enabling reduction in an amount of plating that is deposited on the edge part of the planar workpiece.

The electrodes and the first insulating parts that are formed on the front member 13 are described in detail with FIGS. 3, 4, 5(A) and 5(B). FIG. 3 shows, like FIG. 1, the holding apparatus 1 with the rear member 11 and the front member 13 being closed and is a perspective view (partly a cross-sectional view) showing a connecting part of the rear member 11 and the front member 13 in the holding apparatus 1 (the front member 13 is not illustrated). On the other hand, FIG. 4 shows, like FIG. 2, the holding apparatus 1 with the rear member 11 and the front member 13 being opened, and is a perspective view showing a connecting part of the rear member 11 and the front member 13 in the holding apparatus 1. The same parts as those in the above drawings are marked with the same reference signs to avoid a repetition of the descriptions.

As shown in FIGS. 3 and 4, the front member 13 has the plurality of first insulating parts 31 and the plurality of electrodes 32 near the connecting part with the rear member 11, and each of the first insulating parts 31 and each of the electrodes 32 are disposed along an edge of an unillustrated planar workpiece. The connecting part of the rear member 11 and the front member 13 in FIGS. 3 and 4 is positioned in such a manner as to come to an upper part of the holding apparatus 1 when the holding apparatus 1 is stood in the direction of gravity. At this upper part of the front member 13, each of the first insulating parts 31 and each of the electrodes 32 are disposed in a width direction of the unillustrated planar workpiece. On the other hand, each of the first insulating parts 31 and each of the electrodes 32 are also disposed along an edge of the unillustrated planar workpiece at a lower part of the front member 13 of the holding apparatus 1 when the holding apparatus 1 is stood in the direction of gravity.

Figure 5B:
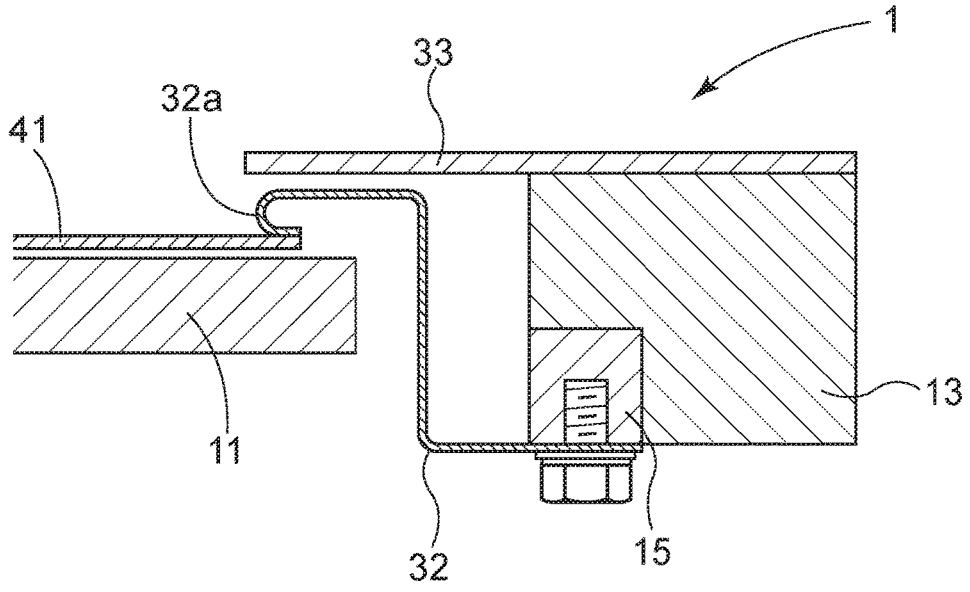
FIG. 5(B) is a cross-sectional view showing the holding apparatus in FIG. 3 that is taken along the line B-B.

FIG. 5(A) is a cross-sectional view of the position (A-A position) on the front member 13 in which one of the first insulating parts 31 is formed, in the holding apparatus 1 in FIG. 3. FIG. 5(B) is a cross-sectional view of the position (B-B position) on the front member 13 in which one of the electrodes 32 is formed, in the holding apparatus 1 in FIG. 3. As shown in FIG. 5(A), a planar workpiece 41 is disposed on the rear member 11. Each of the first insulating parts 31 is a bent planar object as shown in FIG. 5(A). One end of each of the first insulating parts 31 is fixed to the front member 13 with a bolt, and the other end, which is not fixed, has a projection 31*a* in a direction towards a surface of the rear member 11. This projection 31*a* is in contact with the planar workpiece 41. In FIG. 5(B), the planar workpiece 41 is also disposed on the rear member 11. Each of the electrodes 32 is a bent planar object as shown in FIG. 5(B). One end of each of the electrodes 32 is fixed with a bolt to an electric current-transmitting member 15 disposed on the front member 13, and the other end, which is not fixed, has a curved part 32*a* towards the planar workpiece 41. This curved part 32*a* is in contact with the planar workpiece 41.

The holding apparatus 1 of the present invention has the following characteristic. Provided that the edge length of the planar workpiece 41 in the width direction of the planar workpiece 41 or the edge length of the opening part in the direction parallel to the width direction of the planar workpiece 41, whichever is smaller, is defined as 100, the edge part-covering length of the plurality of first insulating parts 31 or the plurality of electrodes 32 is 80 or more in the width direction of the planar workpiece 41 within the edge length of the planar workpiece 41 in the width direction of the planar workpiece 41. That is, the edge part-covering length is within the edge length of the planar workpiece 41 in the width direction of the planar workpiece 41. Setting the edge part-covering length of the plurality of first insulating parts 31 or the plurality of electrodes 32 to be 80 or more within the edge length of the planar workpiece 41 in the width direction of the planar workpiece 41 renders an electric current less likely to flow into the edge part of the planar workpiece 41, thus enabling reduction in an amount of plating that is deposited on the edge part of the planar workpiece 41.

The edge part-covering length of the plurality of first insulating parts 31 or the plurality of electrodes 32 is preferably 90 or more, more preferably 95 or more, and most preferably 100 within the edge length of the planar workpiece 41 in the width direction of the planar workpiece 41.

Figure 6A:
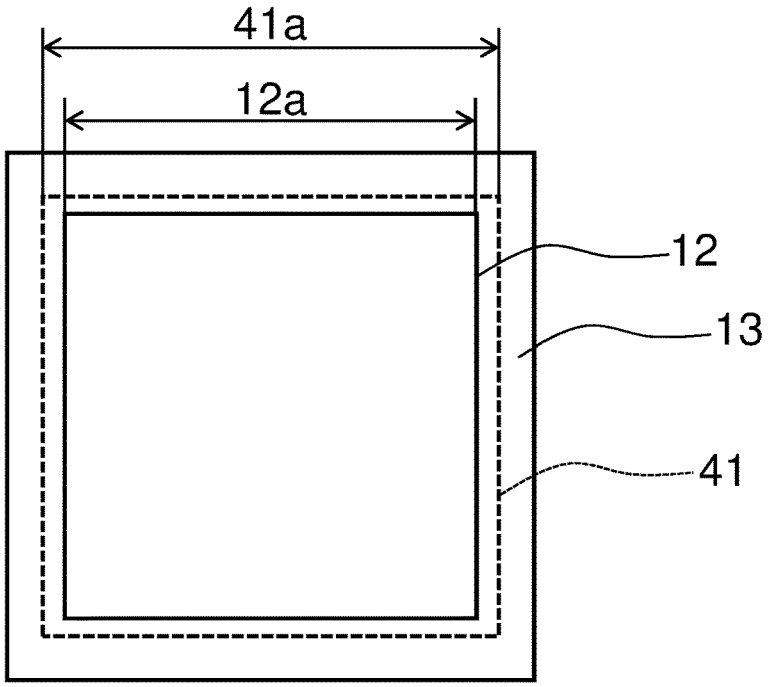
FIGS. 6(A) and 6(B) are schematic views explaining a disposition of a planar workpiece between the rear member and the front member of the holding apparatus.
Figure 6B:
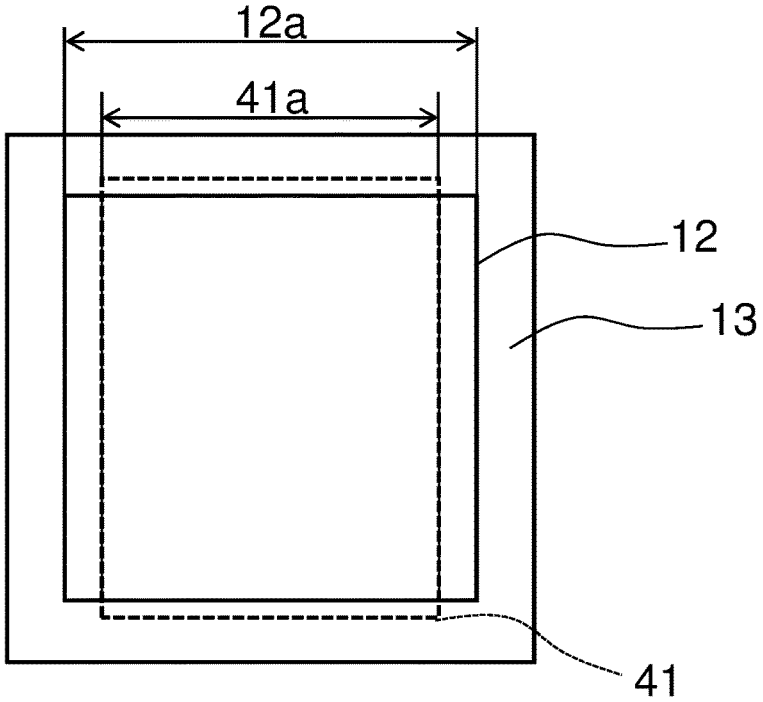

The edge part-covering length of the plurality of first insulating parts 31 or the plurality of electrodes 32 is determined based upon the edge length of the planar workpiece 41 in the width direction of the planar workpiece 41 or the edge length of the opening part in the direction parallel to the width direction of the planar workpiece 41, whichever is smaller, that is defined as 100. That is, the edge length 41*a* of the planar workpiece 41 in the width direction of the planar workpiece 41 and the edge length 12*a* of the opening part 12 in the direction parallel to the width direction of the planar workpiece 41 differ from one another when the planar workpiece 41 is disposed between the rear member 11 and the front member 13 of the holding apparatus 1 as shown in FIGS. 6(A) and 6(B). The edge length 12*a* of the opening part 12 in the direction parallel to the width direction of the planar workpiece 41 may be smaller than the edge length 41*a* of the planar workpiece 41 in the width direction of the planar workpiece 41. Inversely, the edge length 41*a* of the planar workpiece 41 in the width direction of the planar workpiece 41 may be smaller than the edge length 12*a* of the opening part 12 in the direction parallel to the width direction of the planar workpiece 41.

Considering the above, in the present invention, the edge part-covering length of the plurality of first insulating parts 31 or the plurality of electrodes 32 is determined based upon the edge length 41*a* of the planar workpiece 41 in the width direction of the planar workpiece 41 or the edge length 12*a* of the opening part 12 in the direction parallel to the width direction of the planar workpiece 41, whichever is smaller, that is defined as 100. Hence, in FIG. 6(A), the edge length 12*a* of the opening part 12 in the direction parallel to the width direction of the planar workpiece 41 becomes a basis (100) for the edge part-covering length, whereas, in FIG. 6(B), the edge length 41*a* of the planar workpiece 41 in the width direction of the planar workpiece 41 becomes a basis (100) for the edge part-covering length.

Each of the first insulating parts 31 and each of the electrodes 32 are preferably disposed alternately along an edge of the planar workpiece 41. This alternate disposition of each of the first insulating parts 31 and each of the electrodes 32 leads to uniform electric field distribution around each of the electrodes 32, thus being able to achieve a uniform thickness of a plating film. Each of the first insulating parts 31 and each of the electrodes 32 may be disposed in contact with one another or be disposed with space from one another.

More preferably, each of the first insulating parts 31 and each of the electrodes 32 are disposed alternately along the edge of the planar workpiece 41 and are in contact with one another. Disposing each of the first insulating parts 31 and each of the electrodes 32 in contact with one another eliminates space between each of the first insulating parts 31 and each of the electrodes 32, thus rendering an electric current less likely to flow into the edge part of the planar workpiece 41. As a result, an amount of plating that is deposited on the edge part of the planar workpiece 41 can be further reduced.

As shown in FIG. 5(B), an end of each of the electrodes 32 contacts the planar workpiece 41, and this end preferably has the curved part 32*a* towards the planar workpiece 41. In addition, the curved part 32*a* is preferably formed across each of the electrodes 32 in a width direction of each of the electrodes 32.

Forming the curved part 32*a* at one end of each of the electrodes 32 imparts elasticity to the curved part 32*a* like a flat spring, and this elasticity can ensure contact between the curved part 32*a* and the planar workpiece 41 and thus transmission of an electric current. In addition, forming the curved part 32*a* across each of the electrodes 32 in the width direction of each of the electrodes 32 renders an electric current less likely to flow into the edge part of the planar workpiece 41, thus enabling reduction in an amount of plating that is deposited on the edge part of the planar workpiece 41. Examples of a shape of the curved part 32*a* include a curved shape and a bent shape.

Each of the electrodes 32 is preferably covered with an unillustrated insulating film except for a contact point of each of the electrodes 32 with the planar workpiece 41. Covering each of the electrodes 32 with the insulating film except for the contact point enables reduction in an amount of plating that is deposited on each of the electrodes 32. An example of the insulating film includes an insulating resin film but is not particularly limited thereto. Examples of the insulating resin film include a vinyl chloride film, a polyimide film, and a polyethylene terephthalate film.

As shown in FIG. 5(A), each of the first insulating parts 31 preferably has the projection 31*a* in the direction towards the surface of the rear member 11. Forming the projection 31*a* at one end of each of the first insulating parts 31 allows stress exerted on each of the first insulating parts 31 to concentrate at the projection 31*a*. This concentration of stress can ensure that the projection 31*a* presses the planar workpiece 41 against the rear member 11. Such a projection 31*a* can maintain contact between each of the first insulating parts 31 and the planar workpiece 41 even though each of the first insulating parts 31 receives stress. This maintained contact renders an electric current less likely to flow into the edge part of the planar workpiece 41 even in the presence of a plating solution around the edge part of the planar workpiece 41, thus enabling reduction in an amount of plating that is deposited on the edge part of the planar workpiece 41. Besides, the presence of the plating solution around the edge part of the planar workpiece 41 renders heat that would be generated during the electrolytic plating treatment more likely to dissipate, thus being able to lower an electric resistance.

The projection 31*a* may have a pointed shape extending in a perpendicular direction to the surface of the rear member 11 as shown in FIG. 5(A), or have a spherical shape, but a shape of the projection 31*a* is not particularly limited thereto. Also, the projection 31*a* may have the curved part 32*a* towards the planar workpiece 41 as shown in FIG. 5(B).

The projection 31*a* is preferably formed across each of the first insulating parts 31 in an entire width direction of each of the first insulating parts 31 (that is, entirely in the direction in which each of the first insulating parts 31 covers the edge part of the planar workpiece 41 in the width direction of the planar workpiece 41). Forming the projection 31*a* across each of the first insulating parts 31 in the width direction of each of the first insulating parts 31 renders an electric current less likely to flow into the edge part of the planar workpiece 41, thus enabling reduction in an amount of plating that is deposited on the edge part of the planar workpiece 41.

Each of the first insulating parts 31 may not contact the planar workpiece 41 but preferably contacts the edge part of the planar workpiece 41. Bringing each of the first insulating parts 31 into contact with the planar workpiece 41 renders an electric current less likely to flow into the edge part of the planar workpiece 41, thus enabling further reduction in an amount of plating that is deposited on the edge part of the planar workpiece 41. A material for each of the first insulating parts 31 may be any insulating material. Examples of the insulating material include vinyl chloride, polyimide, and polyethylene terephthalate. In addition, the material for each of the first insulating parts 31 preferably has elasticity.

As shown in FIG. 5(B), the front member 13 has a second insulating part 33, and the second insulating part 33 preferably covers each of the electrodes 32 and/or each of the first insulating parts 31. Covering each of the electrodes 32 and/or each of the first insulating parts 31 with the second insulating part 33 can assure a shielding effect of the second insulating part 33 on an electric current, thus enabling further reduction in an amount of plating that is deposited on the edge part of the planar workpiece 41. In the holding apparatus 1 according to an embodiment of the present invention, the second insulating part 33 more preferably covers each of the electrodes 32 and each of the first insulating parts 31.

The second insulating part 33 preferably has a projection (for example, a weir) in a direction towards the surface of the rear member 11, and the projection is formed at a peripheral edge of the opening part 12. Forming the projection at an end part of the second insulating part 33 in the direction towards the surface of the rear member 11 renders an electric current far less likely to flow into the edge part of the planar workpiece 41, thus enabling further reduction in an amount of plating that is deposited on the edge part of the planar workpiece 41.

In particular, upon performing a Cu plating treatment as the electrolytic plating treatment, the holding apparatus with the second insulating part 33 that is formed on the front member 13 is preferably used, and more preferably, in the holding apparatus, the projection (for example, a weir) is formed at the edge part of the opening part 12 in the direction towards the surface of the rear member 11.

The front member 13 and the second insulating part 33 may be an integrated structure, but, as shown in FIGS. 5(A) and 5(B), the second insulating part 33 is preferably formed on the front member 13 as a separate member. Forming the front member 13 and the second insulating part 33 as separated members enables a size or a shape of the second insulating part 33 to be easily changed.

An embodiment of the present invention includes a method for applying an electrolytic plating treatment to a planar workpiece with the holding apparatus according to an embodiment of the present invention, and the electrolytic plating treatment is performed with each of the electrodes in contact with a plating solution. Performing the electrolytic plating treatment with each of the electrodes in contact with the plating solution facilitates transmission of an electric current and dissipation of heat, thus lowering an electric resistance. Such a lowered electric resistance consequently facilitates the plating treatment.

A description is given to the method for applying the electrolytic plating treatment to a planar workpiece with the holding apparatus according to an embodiment of the present invention. Firstly, the rear member 11 and the front member 13 are opened as shown in FIG. 2, and the planar workpiece is disposed on the surface of the rear member 11 that faces the front member 13 (not illustrated). Then, the rear member 11 and the front member 13 are closed as shown in FIG. 1 and locked with open/close locks 14*a* and 14*b* to prevent the rear member 11 and the front member 13 from opening. Thereafter, the holding apparatus 1 in which the planar workpiece is disposed is, for example, immersed in a plating solution in a treatment tank to perform the electrolytic plating treatment. After the electrolytic plating treatment, the holding apparatus 1 is cleaned, with the planar workpiece held in the holding apparatus 1. Then, the open/close locks 14*a* and 14*b* are unlocked, and the rear member 11 and the front member 13 are opened to take the planar workpiece from the holding apparatus 1.

<Others>

On an edge part of the planar workpiece 41, an insulating film may be formed. An example of the insulating film includes an insulating resin film, but the insulating film is not particularly limited thereto. Examples of the insulating resin film include a vinyl chloride film, a polyimide film, and a polyethylene terephthalate film. A width of the formed insulating film is preferably around 5 to 15 mm, for example, but is not particularly limited thereto. The insulating film is preferably formed on a part of the planar workpiece 41 including the edge thereof.

The open/close locks 14*a* and 14*b* may be any open/close locks that can prevent the rear member 11 and the front member 13 from opening during the electrolytic plating treatment without any particular limitation on their types. Examples of such open/close locks include ones having a projection and a recess that fit one another and ones that use magnetic force.

Beneath the holding apparatus 1, a guide 21 is preferably provided. This guide 21 can fix the holding apparatus 1 in the treatment tank for the electrolytic plating treatment by being inserted into a guide support provided in the treatment tank.

REFERENCE SIGNS LIST

1 holding apparatus
11 rear member
12 opening part
12*a* edge length of the opening part 12 in a direction parallel to a width direction of a planar workpiece 41
13 front member
14*a*, 14*b* open/close locks
15 electric current-transmitting member
21 guide
31 first insulating part
31*a* projection
32 electrode
32*a* curved part
33 second insulating part
41 planar workpiece
41*a* edge length of the planar workpiece 41 in the width direction of the planar workpiece 41

The invention claimed is:

1. A holding apparatus for holding a planar workpiece during an electrolytic plating treatment, the holding apparatus comprising:

a rear member; and a front member connected to the rear member and having an opening part, the front member facing the rear member in a closed position, wherein the planar workpiece is disposed between the rear member and the front member in the closed position so that the planar workpiece is at least partially exposed at the opening part, the front member has a plurality of electrodes and a plurality of first insulating parts disposed along an edge part of the opening part in the width direction of the opening part, the planar workpiece has a first surface that faces the front member in the closed position and is exposed at the opening part and a second surface that faces the rear member in the closed position, the plurality of electrodes and the plurality of first insulating parts are configured to cover an edge part of the planar workpiece in a width direction of the planar workpiece, the plurality of electrodes and the plurality of first insulating parts are configured to contact the first surface of the planar workpiece when held in the closed position, the plurality of first insulating parts and the plurality of electrodes are arranged to extend along substantially an entire length of an upper or lower edge of the opening part of the front member, and the first insulating parts and the electrodes are disposed, one after the other, along an edge of the opening part so that each of the electrodes is exposed to a plating solution during the electrolytic plating treatment.

2. The holding apparatus according to claim 1, wherein each of the first insulating parts has a projection that projects towards the rear member.

3. The holding apparatus according to claim 2, wherein the projection is formed across each of the first insulating parts in a width direction of each of the first insulating parts.

4. The holding apparatus according to claim 1, wherein an end of each of the electrodes is configured to contact the planar workpiece, the end has a curved part directed towards the rear member, and the curved part is formed across each of the electrodes in a width direction of each of the electrodes.

5. The holding apparatus according to claim 1, wherein the front member has a second insulating part, and the second insulating part covers each of the first insulating parts and/or each of the electrodes.

6. The holding apparatus according to claim 5, wherein the second insulating part has a projection towards the rear member, the projection is formed at a peripheral edge of the opening part.

7. The holding apparatus according to claim 1, wherein each of the first insulating parts is configured to contact the edge part of the planar workpiece.

8. The holding apparatus according to claim 1,
wherein each of the first insulating parts is in contact with an adjacent electrode of the plurality of electrodes.

9. The holding apparatus according to claim 1,
wherein each of the electrodes is covered with an insulating film except for a contact point of each of the electrodes with the planar workpiece.

10. The holding apparatus according to claim 1,
wherein each of the electrodes can transmit electric current to the planar workpiece when coming into contact with the planar workpiece, and each of the first insulating parts shields an edge part of the planar workpiece to as to prevent electric current from flowing into the edge part of the planar workpiece.

11. The holding apparatus according to claim 1,
wherein each of the first insulating parts is spaced from an adjacent electrode of the plurality of electrodes.

12. A method for applying an electrolytic plating treatment to a planar workpiece with the holding apparatus according to claim 1,
wherein the electrolytic plating treatment is performed with each of the electrodes in contact with a plating solution.

* * * * *